US010124622B2

(12) United States Patent
Schumacher

(10) Patent No.: US 10,124,622 B2
(45) Date of Patent: Nov. 13, 2018

(54) PENCIL SHARPENER WITH PENCIL-CENTERING MECHANISM

(71) Applicant: ELMER'S PRODUCTS, INC., Westerville, OH (US)

(72) Inventor: Michael J. Schumacher, Hilliard, OH (US)

(73) Assignee: Sanford, L.P., Atlanta, GA (US)

( * ) Notice: Subject to any disclaimer, the term of this patent is extended or adjusted under 35 U.S.C. 154(b) by 229 days.

(21) Appl. No.: 14/988,127

(22) Filed: Jan. 5, 2016

(65) Prior Publication Data

US 2017/0190207 A1 Jul. 6, 2017

(51) Int. Cl.
*B43L 23/02* (2006.01)
*B43L 23/00* (2006.01)

(52) U.S. Cl.
CPC ..... *B43L 23/008* (2013.01); *B43L 23/02* (2013.01)

(58) Field of Classification Search
CPC ..... B43L 23/00; B43L 23/004; B43L 23/008; B43L 23/02; B43L 23/04; B43L 23/06; B43L 23/08; B43L 23/085
See application file for complete search history.

(56) References Cited

U.S. PATENT DOCUMENTS 7,360,566 B2 * 4/2008 Chang ..... B43L 23/00 144/28.5
2013/0147104 A1 * 6/2013 Saito ..... B43L 23/008 269/218

FOREIGN PATENT DOCUMENTS

CH 181271 A * 12/1935 ..... B43L 23/008
DE 1063934 B * 8/1959 ..... B43L 23/04

* cited by examiner

*Primary Examiner* — Matthew G Katcoff
(74) *Attorney, Agent, or Firm* — Eversheds Sutherland (US) LLP

(57) ABSTRACT

A pencil-centering assembly for use in pencil sharpeners or the like that includes a frame; a linking member rotatably mounted within the frame; a plurality of pencil contact levers, wherein each contact lever includes a top portion and a bottom portion, wherein the top portion of each pencil contact lever is adapted to engage the linking member, wherein the bottom portion of each pencil contact lever, in combination with the other pencil contact levers, defines a pencil insertion aperture having a center axis, and wherein the bottom portion of each pencil contact lever extends in to the pencil insertion aperture to about the same distance; and at least one biasing member in contact with the linking member, wherein the biasing member exerts force on each pencil contact lever by way of the linking member sufficient to bias each pencil contact lever toward the center axis of the pencil insertion aperture.

27 Claims, 8 Drawing Sheets

PENCIL SHARPENER WITH PENCIL-CENTERING MECHANISM

BACKGROUND OF THE INVENTION

The described invention relates in general to sharpening devices, and more specifically to a sharpener for use with pencils or other items, wherein the sharpener includes an integrated pencil-centering mechanism and optional pencil diameter selection dial. This invention also relates to an electric pencil sharpener having a tool-less cutter-carrier replacement feature that uses only one electrical switch for both pencil insertion activation and electrical interlock when the cutter-carrier is accessed for replacement. Certain aspects of this invention may be used with mechanical (i.e., crank sharpeners) and/or electric sharpeners that are consumer products or that are intended for commercial or industrial applications.

Pencils are commonly used writing or marking implements that must be regularly sharpened during use. One of the most frequent user complaints with regard to pencil sharpeners is that the pencil core is not sharpened evenly, with the graphite core being centered in the body of the sharpened pencil. A contributing factor to this problem is that the user of the pencil does not insert the pencil into the sharpener directly on axis with the internal cone of the cutter-carrier assembly of the sharpener. This may occur if the pencil is not supported radially where it enters the cutter-carrier, either due to too large an aperture (in mechanical or electric pencil sharpeners) or in some cases, in electric pencil sharpeners, due to a pencil switch actuation slide or lever that biases the pencil to one side. Commercially available electric pencil sharpeners typically include only one slide or lever which biases the pencil radially to one side and tends to push it off the axis of the cutter-carrier. Some known designs attempt to negate this effect by using two opposing slides or levers. One slide or lever actuates an electric switch while the other counteracts the switch force from the other side of the pencil. This two-slide design is an improvement, but the pencil is sometimes provided with minimal support perpendicular to the slides or levers and the self-centering tendency is often weak because the slides are mechanically independent (i.e., unlinked) and the centering effect is due to the difference between the two spring forces driving the slides or levers. Thus, there is an ongoing need for a sharpener with an effective centering mechanism.

Commercially available pencil sharpeners also typically include a simple rotating disc with a plurality of apertures having different diameters for supporting pencils of various sizes and/or shapes. This disc is positioned on an axis offset by some distance from the pencil entry aperture of the cutter-carrier with the apertures typically positioned on a circle with a radius equal to that distance so that the holes are concentric with the sharpener's cutter-carrier. With offset rotating aperture pencil-size-selection discs that are common in electric pencil sharpeners, when presented on the outside of the sharpener, with all possible pencil apertures visible, there is some ambiguity about which aperture leads to the cutter-carrier (sharpening) mechanism. In some cases, it is the aperture directly above (behind) the center axis of the dial, and in other cases, it is the aperture directly below (in front of) the dial axis. In some electric pencil sharpeners, the rotating selector dial is recessed internally within the enclosure of the sharpener, leaving only the outer circumference portion accessible for adjustment, then presenting only one pencil-entry aperture on the external enclosure. However, this makes it more difficult for the user to select the correct aperture because not all of the choices are visible at once and the direction of increasing or decreasing size is unclear. Thus, there is an ongoing need for a sharpener with an easy to understand and effective size indicator and size limiting dial.

Because the helical cutters used in electric pencil sharpeners are the primary wearing component, it is useful to provide a convenient (quick and tool-free) means of replacement when these parts eventually wear out. This can be accomplished by providing a removable cap or cover that allows user access to a removable cutter-carrier assembly. However, care must be taken so that the cutter(s) and the motor driving the cutter(s) cannot be activated while the cap or cover, which normally provides mechanical shielding from the rotating cutter(s), is removed. Such protection is commonly provided in electrical equipment by an interlock switch. It is the best practice in the industry to implement these types of interlock switches with mechanical guarding so that the switches cannot be intentionally or inadvertently reactivated (bypassed) by a finger. In existing electric pencil sharpeners that have removable covers for accessing the cutter-carrier assembly for replacement, there are usually two mechanical linkages and two electrical switches that provide for motor activation on pencil insertion and safety interlock when the cover portion is removed. Further, in electric pencil sharpeners, the motor-actuation pencil switch is commonly located on the main structure of the sharpener, adjacent to the cutter-carrier assembly. The temporary removal of the cap or cover often provides the most direct access to the cutter-carrier assembly. The cap or cover, containing the pencil-contacting portions of the switch, is then removed while the electrical and drive motor components remain with the base portion of the sharpener. The cover may contain an electrical switch and remain tethered by wires to the base sharpener, but this creates design and electrical insulation complications. Thus, there is an ongoing need for a pencil-switch-to-sharpener-base linkage that can be readily disconnected and reconnected and that provides enhanced safety.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a first pencil-centering assembly for use with pencil-sharpeners is provided. This pencil-centering assembly includes a frame; a linking member rotatably mounted within the frame; a plurality of pencil contact levers, wherein each contact lever in the plurality of pencil contact levers includes a top portion and a bottom portion, wherein the top portion of each pencil contact lever is adapted to engage the linking member, wherein the bottom portion of each pencil contact lever, in combination with the other pencil contact levers, defines a pencil insertion aperture having a center axis, and wherein the bottom portion of each pencil contact lever extends in to the pencil insertion aperture to about the same predetermined distance; and at least one biasing member in contact with the linking member, wherein the at least one biasing member exerts force on each pencil contact lever by way of the linking member sufficient to bias each pencil contact lever toward the center axis of the pencil insertion aperture.

In accordance with another aspect of the present invention, a second pencil-centering assembly for use with pencil-sharpeners is provided. This pencil-centering assembly includes frame, wherein the frame is adapted to be detachably mounted within the housing of a pencil sharpener; a linking member rotatably mounted within the frame; a plurality of pencil contact levers, wherein each contact lever in the plurality of pencil contact levers includes a top portion and a bottom portion, wherein the top portion of each pencil contact lever is adapted to engage the linking member, wherein the bottom portion of each pencil contact lever, in combination with the other pencil contact levers, defines a pencil insertion aperture having a center axis, and wherein the bottom portion of each pencil contact lever extends in to the pencil insertion aperture to about the same predetermined distance; and a plurality of biasing members connected to the linking member, wherein the each biasing member exerts force on each pencil contact lever by way of the linking member sufficient to bias each pencil contact lever toward the center axis of the pencil insertion aperture.

In yet another aspect of this invention, a third pencil-centering assembly for use with pencil-sharpeners is provided. This pencil-centering assembly includes a frame, wherein the frame is adapted to be detachably mounted within the housing of a pencil sharpener; a linking member rotatably mounted within the frame; a plurality of pencil contact levers, wherein each contact lever in the plurality of pencil contact levers includes a top portion and a bottom portion, wherein the top portion of each pencil contact lever is adapted to engage the linking member, wherein the bottom portion of each pencil contact lever, in combination with the other pencil contact levers, defines a pencil insertion aperture having a center axis, wherein the bottom portion of each pencil contact lever extends in to the pencil insertion aperture to about the same predetermined distance, and wherein each pencil contact lever includes a cam lobe formed in the bottom portion thereof; at least one biasing member connected to the linking member, wherein the at least one biasing member exerts force on each pencil contact lever by way of the linking member sufficient to bias each pencil contact lever toward the center axis of the pencil insertion aperture; a pencil size selector dial rotatably attached to the frame and concentrically located with the pencil insertion aperture, wherein the pencil size selector dial further includes a plurality of pencil size indicators located on the exterior of the pencil size selector dial, wherein each indicator corresponds to a predetermined pencil size limit; a cam surface located on the interior of the pencil size selector dial, wherein upon insertion of a pencil into the pencil insertion aperture, the cam lobes on each pencil contact lever move outward toward the cam surface, wherein the travel distance of each pencil contact lever is restricted from the point of contact of each cam lobe to the cam surface; and wherein the relative location of each cam lobe is varied slightly on each pencil contact lever such that each cam lobe contacts a unique position on the cam surface at each discrete orientation of the pencil size selector dial.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
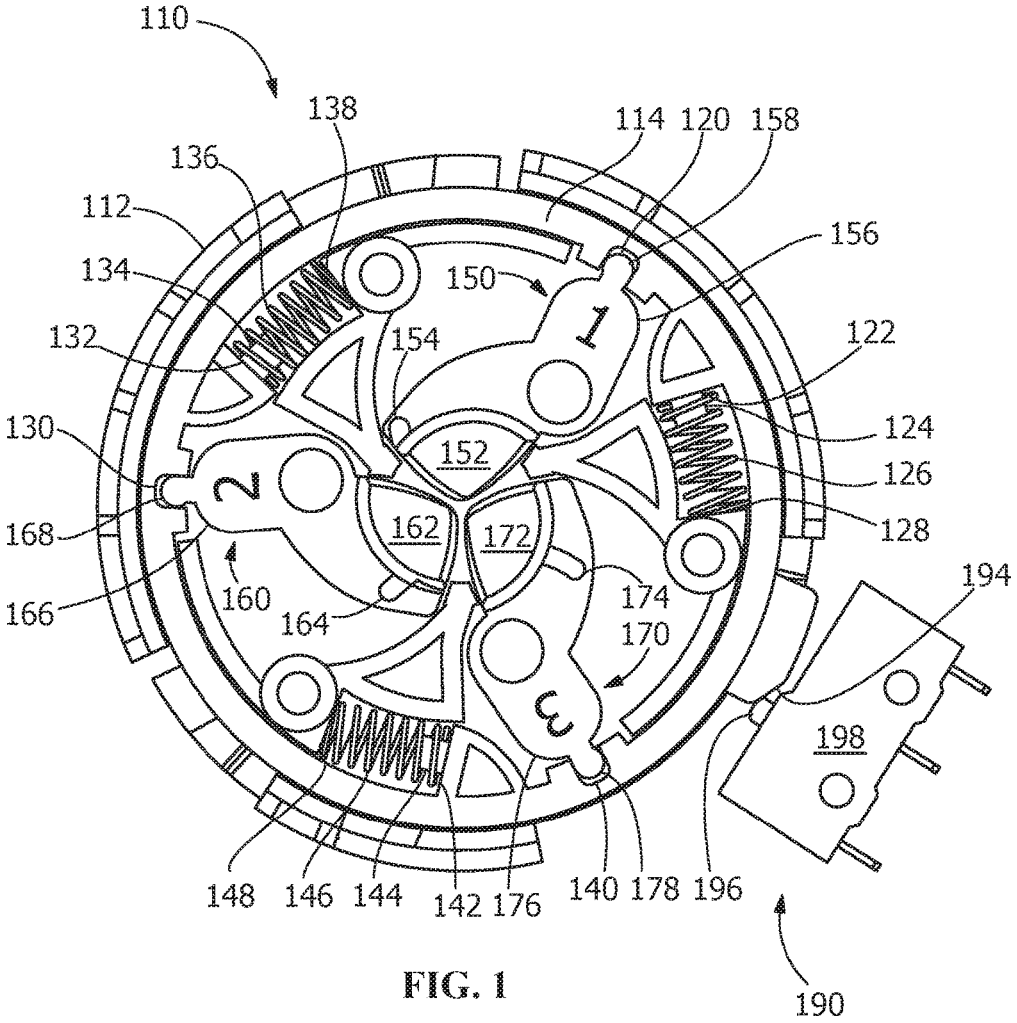
FIG. 1 is a front view of a pencil-centering mechanism, in accordance with an exemplary embodiment of the present invention.

Exemplary embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention provides a pencil sharpening system that includes several advantageous features, including (i) a pencil-centering mechanism that aligns a pencil to be sharpened with the axis of the cutter-carrier device that sharpens the pencil; (ii) a rotatable pencil diameter/shape selecting dial that is mechanically linked to the pencil-centering mechanism for limiting the size of the aperture into which the pencil may be inserted; and (iii) a single separable mechanical linkage between a pencil and an electric motor activation switch that also acts as an interlock for the electric motor of the sharpener.

In the exemplary embodiment of this invention shown in the Figures, at least three rotating levers or slides are arranged around the pencil (or other item to be sharpened) for maintaining the position of the pencil on-center with the cutter-carrier axis of the sharpener. These levers are also mechanically linked by an additional rotary member and the entire mechanism is biased with a spring or springs so that the pencil-contacting points of the levers are directed inwards toward the cutter-carrier axis. When a pencil is inserted without any external bias applied thereto, it will come to rest with its axis in alignment with the axis of the cutter-carrier, with each lever or slide applying a near-equal, inward, radial force to the pencil. If an external radial bias is applied (e.g., by the user's hand), the lever located nearest in that radial direction will resist any motion of the pencil with an increasing force while the levers in the other directions will gradually push on the pencil with reduced force and potentially to zero force. This may continue until the opposing lever is providing all of the center-returning force and the opposite levers are providing none. The centering mechanism, therefore, provides a strong return-to-center tendency to the pencil.

Figure 2:
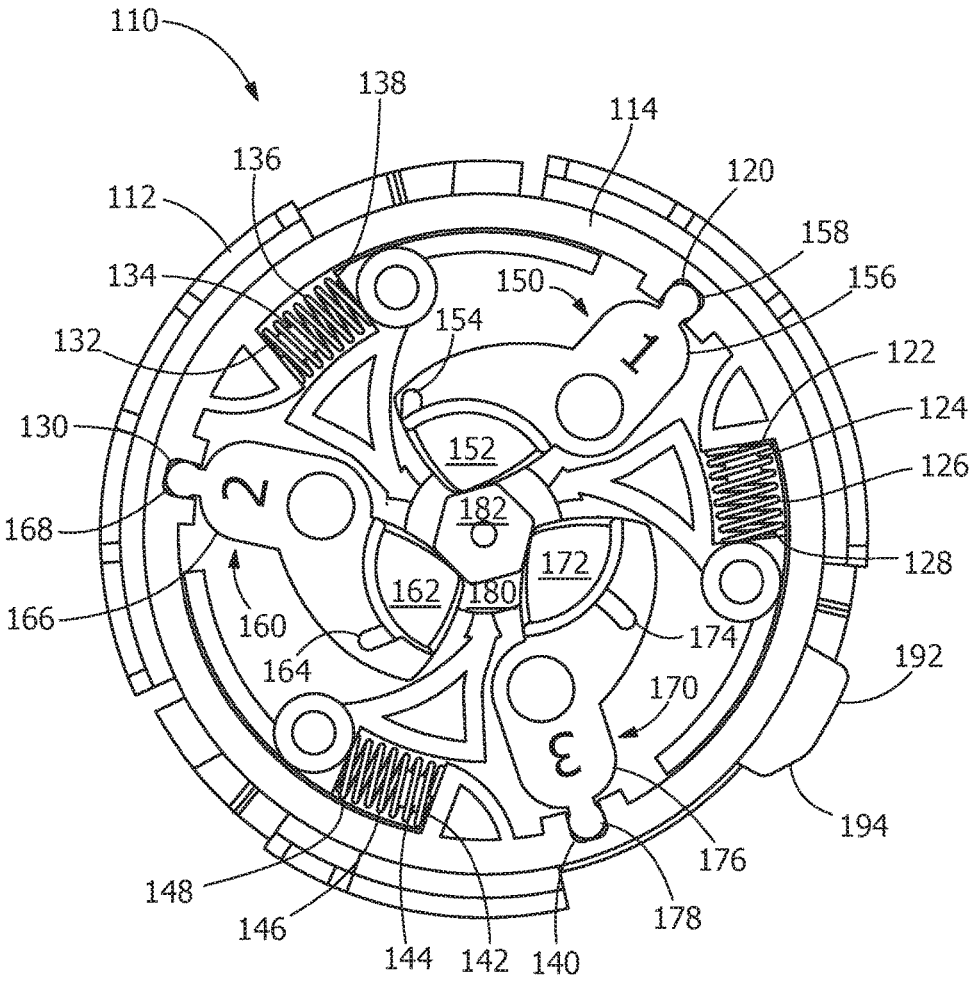
FIG. 2 is a front view of the pencil-centering mechanism of FIG. 1, showing a pencil centered within the pencil-centering mechanism.
Figure 5:
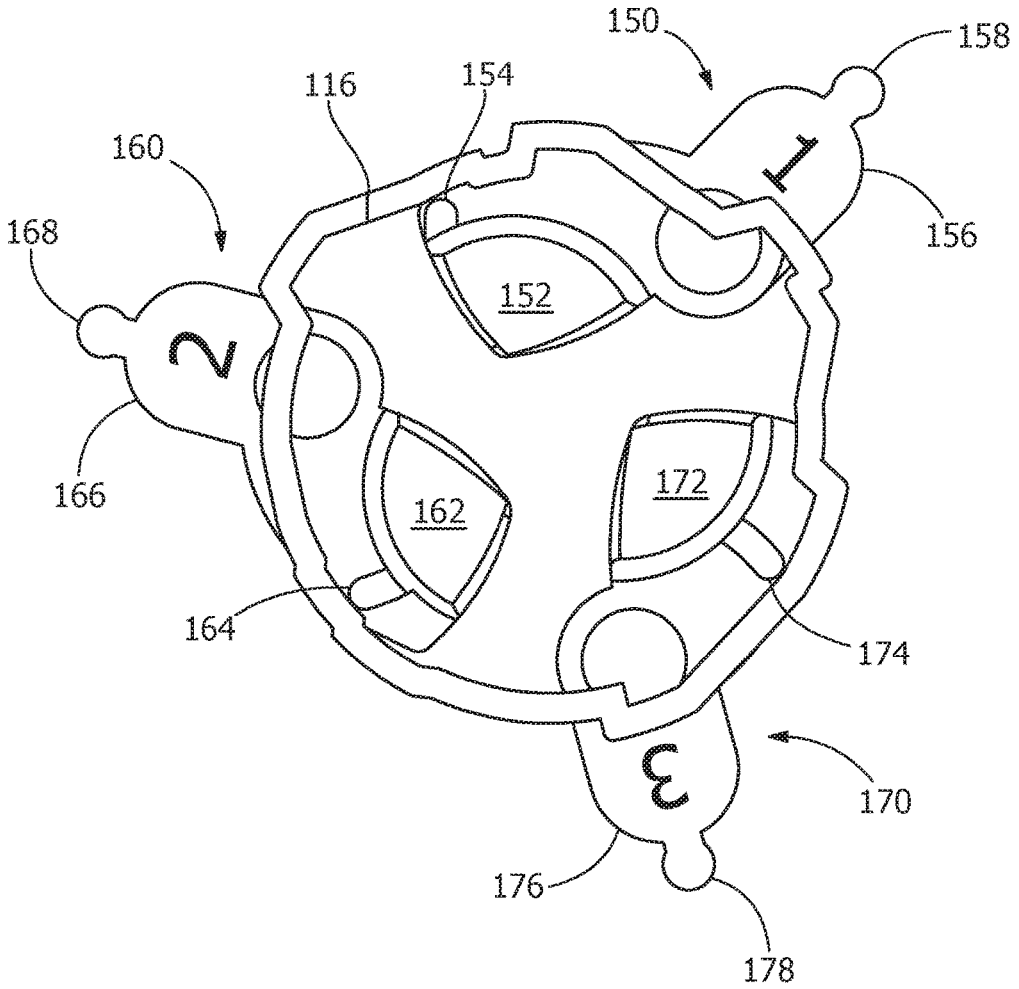
FIG. 5 is a front view of the lever and cam assembly that accommodates variable diameters of pencils inserted into the sharpener, in accordance with an exemplary embodiment of the present invention.

With specific reference to FIGS. 1-2 and 5, an exemplary pencil centering mechanism 110 includes frame 112, linking member 114, and variable cam surface 116. Linking member 114 includes first notch 120, first contact surface 122 having post 124 formed thereon, first biasing member 126, and second contact surface 128, wherein first biasing member 126 is disposed between first and second contact surfaces 122 and 128 respectively. Linking member 114 also includes second notch 130, third contact surface 132 having post 134 formed thereon, second biasing member 136, and fourth contact surface 138, wherein second biasing member 136 is disposed between third and fourth contact surfaces 132 and 138 respectively. Linking member 114 also includes third notch 140, fifth contact surface 142 having post 144 formed thereon, third biasing member 146, and sixth contact surface 148, wherein third biasing member 146 is disposed between fifth and sixth contact surfaces 142 and 148 respectively.

Again with reference to FIGS. 1-2, centering mechanism 110 further includes three levers, equally-spaced at angles of about 120° for centering pencil 182 within pencil insertion aperture 180. These levers are linked to one another by linking member 114 such that the levers extend into pencil insertion aperture 180 to approximately the same distance. The levers are biased toward the center axis of pencil insertion aperture 180 by first, second, and third biasing members 126, 136, and 146, which in the embodiment shown in the Figures, are springs. First lever 150 includes pencil-contacting bottom portion 152 that further includes first cam lobe 154, and top portion 156 that further includes protrusion 158. Protrusion 158 engages first notch 120 in linking member 114. Second lever 160 includes pencil-contacting bottom portion 162 that further includes second cam lobe 164, and top portion 166 that further includes protrusion 168. Protrusion 168 engages second notch 130 in linking member 114. Third lever 170 includes pencil-contacting bottom portion 172 that further includes third cam lobe 174, and top portion 176 that further includes protrusion 178. Protrusion 178 engages third notch 140 in linking member 114. Bottom portions 152, 162, and 172 extend equally into pencil insertion aperture 182 and are held in place by force exerted on each of the three levers 150, 160, and 170 by biasing members 126, 136, and 146 respectively. In the embodiment shown in FIGS. 1-2, the biasing members act on the three levers through linking member 114; however, in one or more alternate embodiments, the biasing members may act on the levers directly.

Figure 3:
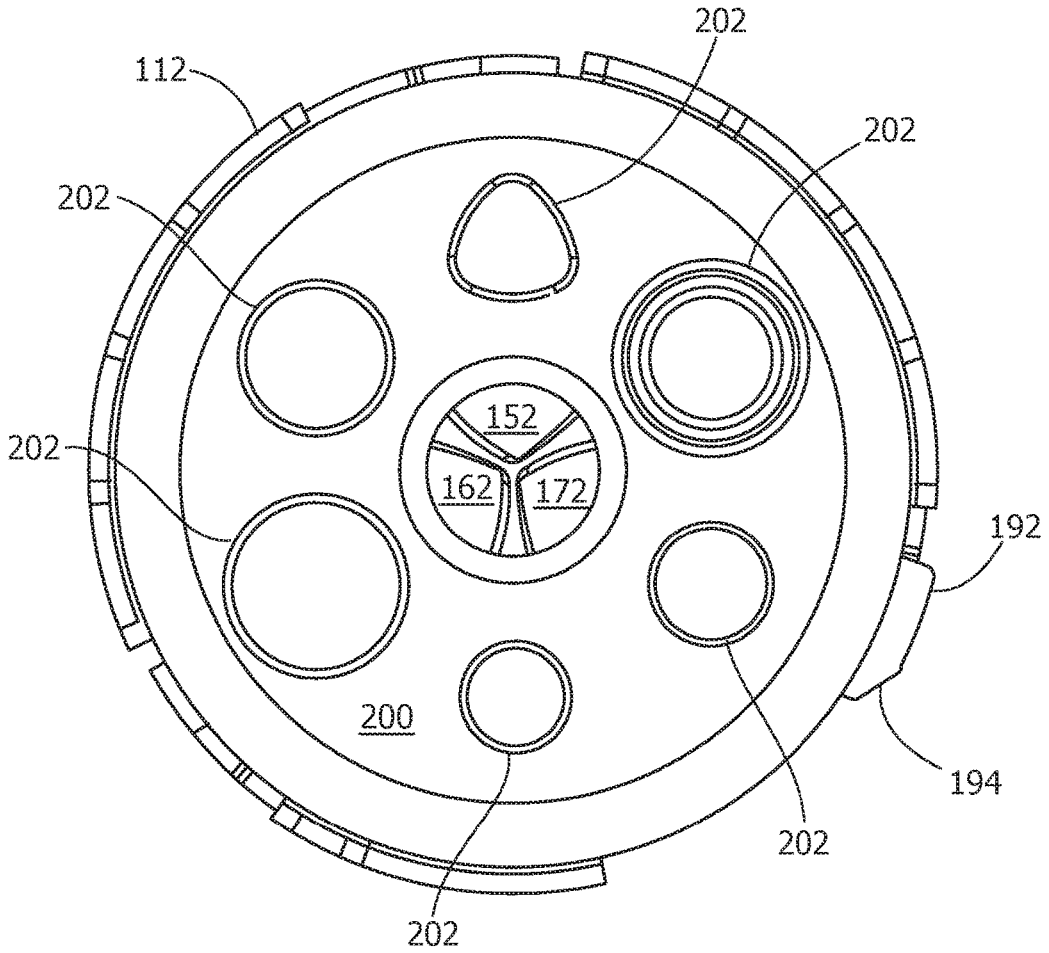
FIG. 3 is a front view of a pencil-size selector dial, in accordance with an exemplary embodiment of the present invention.
Figure 4:
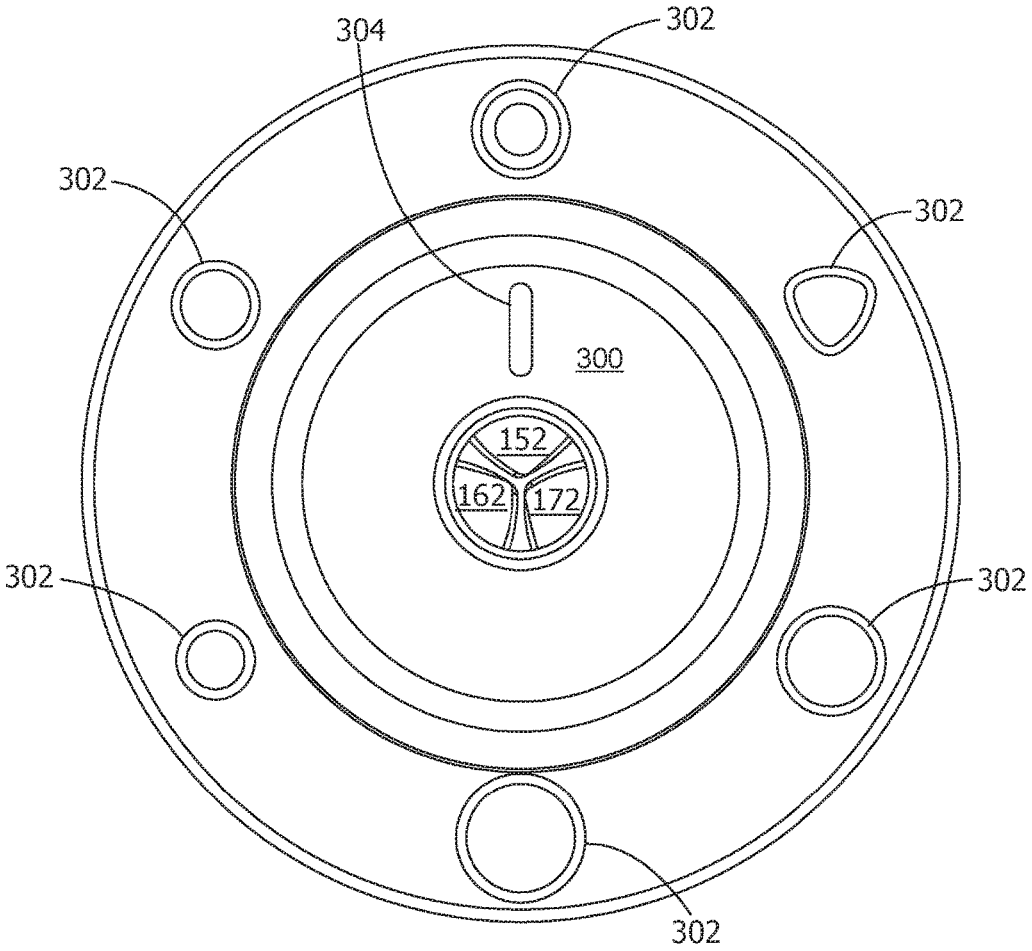
FIG. 4 is a front view of an alternate pencil-size selector dial, in accordance with another exemplary embodiment of the present invention.

Certain embodiments of this invention also include a rotating selector dial that provides a visual representation of the maximum diameter and/or specific geometry of the pencil or other item that can be placed into pencil insertion aperture 180. This rotatable selector dial is mechanically coupled to a cam device that cooperates with cam lobes 154, 164, and 174 to limit the travel distance of levers 150, 160, and 170. With specific reference to FIGS. 3-5, a first exemplary rotatable selector dial 200 (FIG. 3) includes pencil size/geometry selection indicators 202, wherein indicators 202 represent various available pencil diameters and shapes and are positioned concentrically around the pencil insertion aperture. A second exemplary selector dial 300 (FIG. 4) includes rotatable selector dial 300, which further includes visual indicator 304, which may be a mark, notch, ridge, or other structure, and size indicators 302, which are fixed around the perimeter of the face of the sharpener. In this embodiment, indicators 302 represent various available pencil sizes and shapes, while visual indicator 304 provides a clear visual representation of the particular pencil size/shape that has been selected.

With reference to FIG. 5, for both of the selector dials described above, variable cam surface 116 is attached to the inside of the rotating selector dial. Upon insertion of pencil 182 into pencil insertion aperture 180, the cam lobes 154, 164, and 174 on each pencil contact lever 150, 160, and 170 respectively move outward toward cam surface 116. The travel distance of each pencil contact lever is restricted from the point of contact of each cam lobe with variable cam surface 116. The complex shape of cam surface 116 is designed to match a given selected pencil size limit. In the embodiment shown in FIG. 5, the relative location of cam lobes 154, 164, and 174 on pencil contact levers 150, 160, and 170 is varied slightly on each lever so that each cam lobe contacts a unique position on variable cam surface 116 at each of the discrete positions of the pencil size/shape selector dial 200 or 300.

Figure 6:
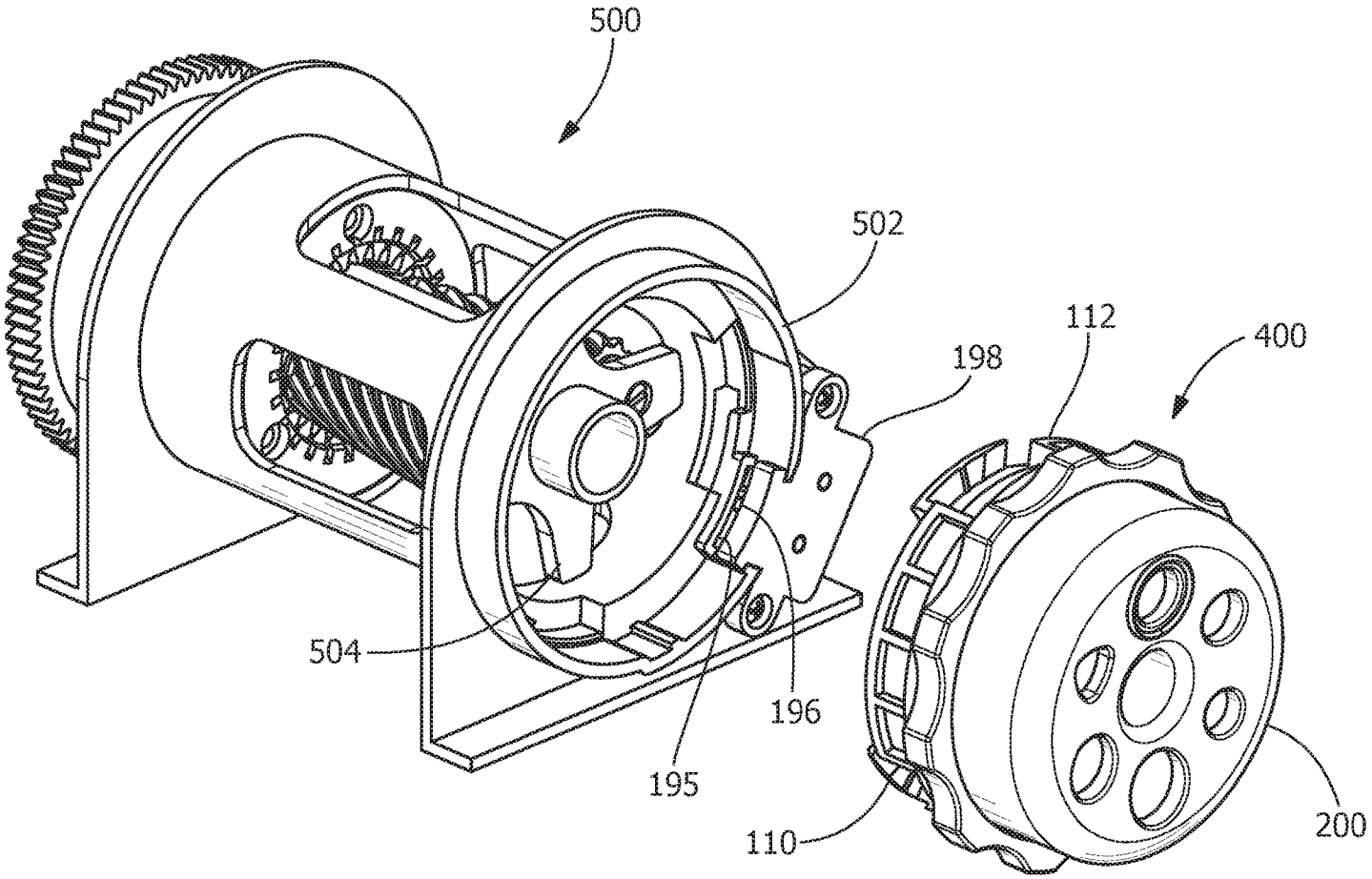
FIG. 6 is a first perspective view of the cap assembly removed from the housing of a pencil sharpener, in accordance with an exemplary embodiment of the present invention.
Figure 7:
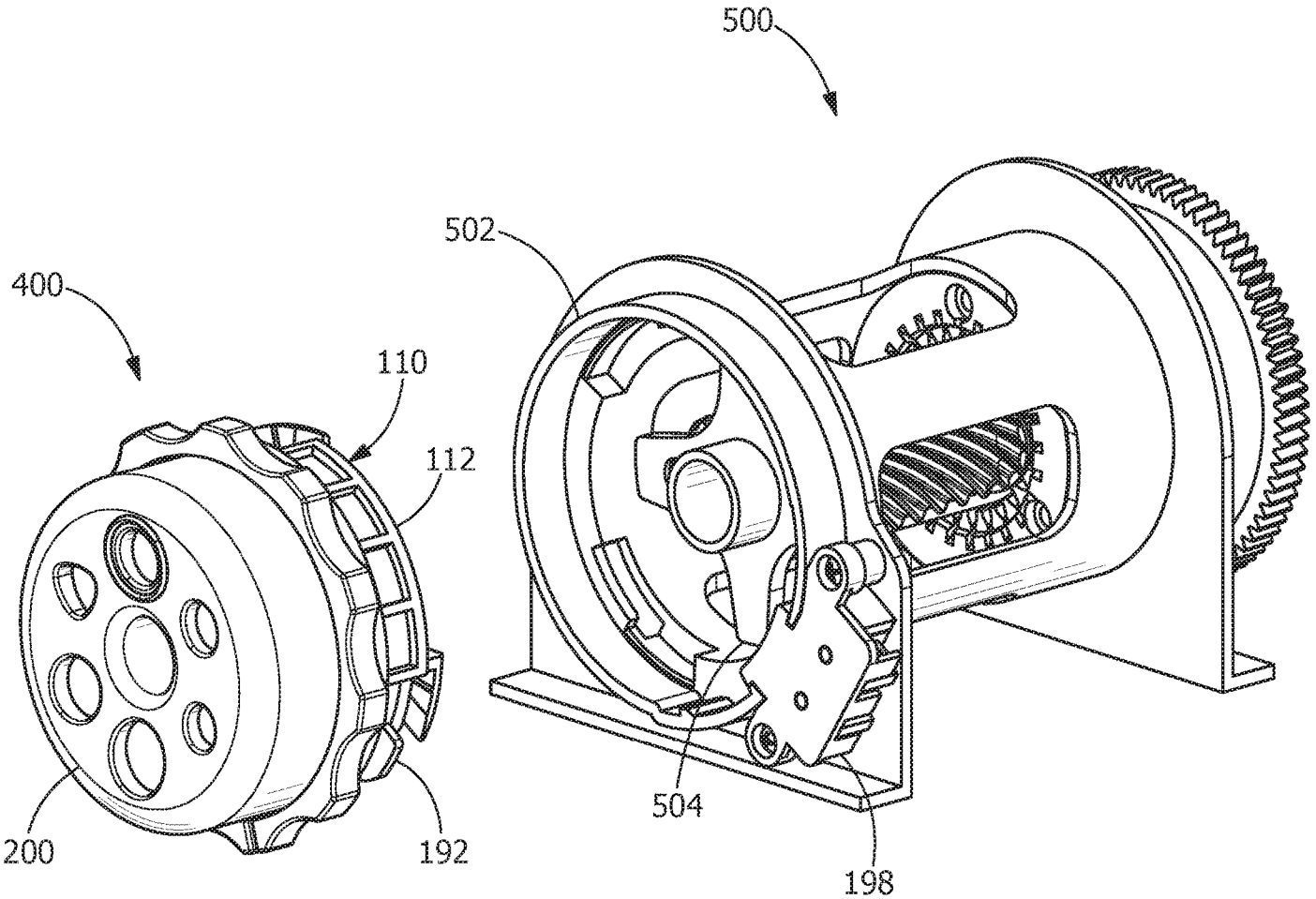
FIG. 7 is a second perspective view of the cap assembly removed from the housing of a pencil sharpener, in accordance with an exemplary embodiment of the present invention.

Certain embodiments of this invention also provide a single mechanical linkage between a pencil and an electric motor activation switch that separates when cap 400 (see FIGS. 6-7) is removed, and that also interlocks the electric motor (and rotating cutters) and blocks inadvertent reactivation, when cap 400 is removed. By mechanically shielding an electro-mechanical pencil-insertion switch so that a human finger cannot be inserted and disconnecting the mechanical linkage between a pencil and an electrical switch when cap 400 is removed, the pencil/switch system also serves as the safety interlock. Since only one electrical switch is needed and the associated wiring, splicing, and assembly labor are eliminated, the cost of the pencil sharpener can be reduced. Similarly, the mechanical component (structure) design can be simplified and the overall component count can be reduced.

With specific reference to FIGS. 1-2 and 6-7, in an exemplary embodiment of this invention, the motor of an electric pencil sharpener is activated by switch subassembly 190, which includes electrical switch 198 and switch activation pin 196. In this embodiment, protrusion 192, which is formed on or attached to linking member 114 in a coplanar manner, includes an inclined surface 194. When detachable cap assembly 400, which includes centering mechanism 110 and rotatable selector dial 200 mounted therein, is properly inserted into opening 502 in sharpener housing 500, inclined surface 194 enters switch guard slot 195 and abuts activation pin 196. When pencil 182 is inserted into pencil insertion aperture 180 and rotates or displaces levers 150, 160, and 170, which then moves linking member 114, inclined surface 194 slides along switch activation pin 196, thereby actuating electrical switch 198 and starting the electrical motor of the sharpener. When pencil 182 is removed from pencil insertion aperture 180, biasing members 126, 136, and 146 will return the entire mechanism to the starting position. When cap assembly 400 is removed from sharpener housing 500 for purposes of accessing cutter/carrier assembly 504, inclined surface 194 on protrusion 192 is no longer in proximity to switch activation pin 196 and thus cannot actuate electrical switch 198. Recessing switch activation pin 196 within switch guard slot 195 prevents any accidental activation of electrical switch 198 by, for example, the finger of a user of the device.

Figure 8:
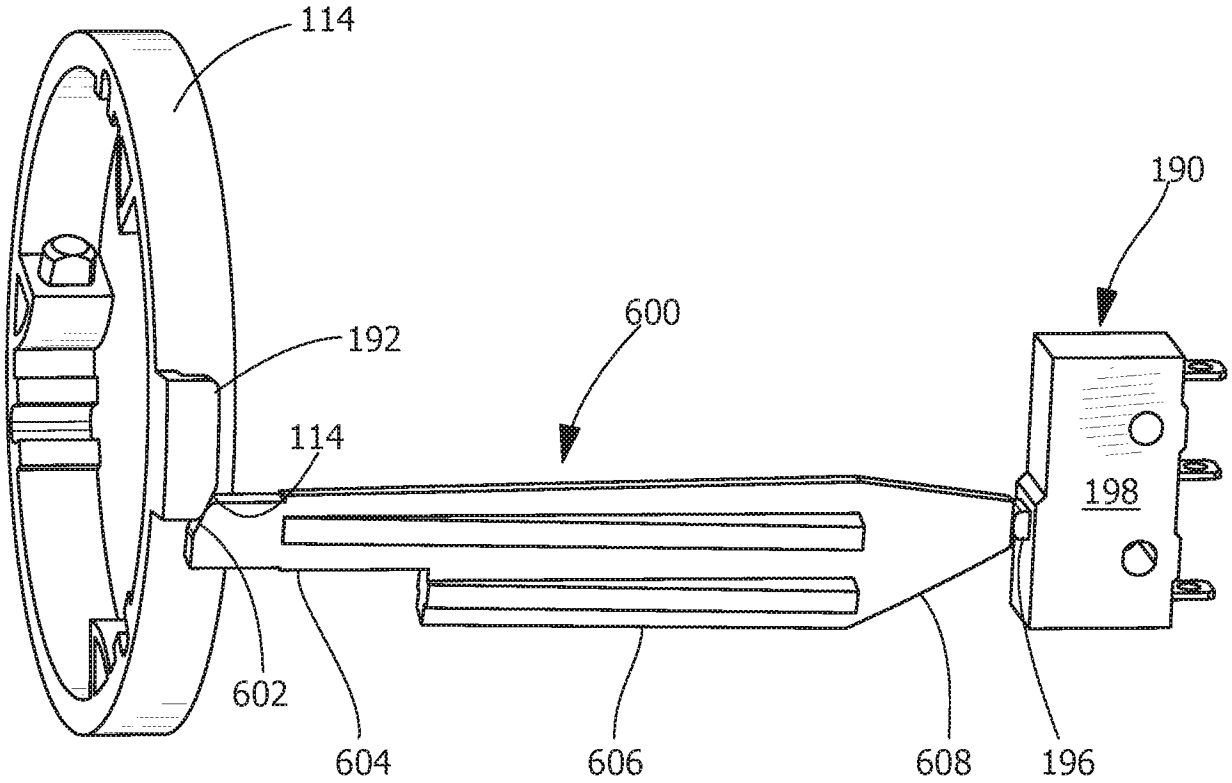
FIG. 8 is a side view of an intermediate pushrod that is used in certain embodiments of this invention to actuate an electrical switch.

With reference to FIG. 8, in an alternate embodiment of this invention, switch subassembly 190 is located more remotely from centering mechanism 110 and intermediate pushrod 600 is used to activate or deactivate electrical switch 198 when cap assembly 400 is attached to or removed from housing 500. Intermediate pushrod 600 includes angled surface 602, which is formed on front portion 604, as well as middle portion 606 and rear portion 608. In this embodiment, protrusion 192 on linking member 114 is oriented (at an angle of about 90° relative to linking member 114) such that inclined surface 194 faces rearward. Protrusion 192 cooperates with angled surface 602 on intermediate pushrod 600 to move the pushrod forward such that rear portion 608 engages switch activation pin 196 when pencil 182 is inserted into pencil insertion aperture 180. Removing cap assembly 400 from housing 500 causes rear portion 608 of intermediate pushrod 600 to disengage from switch activation pin 196 such that electrical switch 198 cannot be activated.

While the present invention has been illustrated by the description of exemplary embodiments thereof, and while the embodiments have been described in certain detail, there is no intention to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the general inventive concept.

What is claimed:

1. A pencil-centering assembly for use with pencil-sharpeners, comprising:

(a) frame;

(b) a linking member rotatably mounted within the frame, the linking member having at least one post and a plurality of notches in an inner surface of the linking member;

(c) a plurality of pencil contact levers, (i) wherein each contact lever in the plurality of pencil contact levers includes a top portion and a bottom portion, (ii) wherein the top portion of each pencil contact lever comprises a protrusion which engages with one of the plurality of notches, (iii) wherein the bottom portion of each pencil contact lever, in combination with the other pencil contact levers, defines a pencil insertion aperture having a center axis, and (iv) wherein the bottom portion of each pencil contact lever extends in to the pencil insertion aperture to about the same predetermined distance; and (d) at least one biasing member disposed upon the post of the linking member, (i) wherein the at least one biasing member exerts force on each pencil contact lever by way of the linking member sufficient to bias each pencil contact lever toward the center axis of the pencil insertion aperture, (e) wherein the assembly is configured such that, upon insertion of a pencil into the pencil insertion aperture, the pencil engages the bottom portion of one or more of the plurality of pencil contact levers such that the one or more of the plurality of pencil contact levers exerts a force on the biasing member that rotates the linking member.

2. The pencil-centering assembly of claim 1, wherein the force exerted by the at least one biasing member on each pencil contact lever is substantially equal.

3. The pencil-centering assembly of claim 1, wherein the plurality of pencil contact levers includes three contact levers equally spaced at 120 degree angles and directed toward the center axis of the pencil insertion aperture.

4. The pencil-centering assembly of claim 1, wherein each pencil contact lever further includes a cam lobe formed in the bottom portion thereof.

5. The pencil-centering assembly of claim 1, further comprising:

(a) a switch actuation protrusion mounted on the linking member, wherein the switch actuation protrusion further includes an inclined surface;

(b) a switch actuation pin adapted to cooperate with the inclined surface; and (c) an electrical micro-switch adapted for use with an electric pencil sharpener, wherein the electrical micro-switch actuates an electric motor included in the electric pencil sharpener when the inclined surface contacts the switch actuation pin.

6. The pencil-centering assembly of claim 1, further comprising:

(a) a switch actuation protrusion mounted on the linking member, wherein the switch actuation protrusion further includes a contoured surface;

(b) a switch actuation pin attached to an electrical micro-switch adapted for use with a pencil sharpener that includes an electric motor; and (c) a pushrod disposed between the switch actuation protrusion mounted on the linking member and the switch actuation pin, (i) wherein pushrod includes a contoured surface on one end thereof that is adapted to cooperate with the contoured surface on the switch actuation protrusion mounted on the linking member and move the pushrod forward into contact with the switch actuation pin when the linking member rotates, and (ii) wherein the electrical micro-switch actuates the electric motor of the pencil sharpener when the pushrod contacts the switch actuation pin.

7. The pencil-centering assembly of claim 4, further comprising a pencil size selector dial rotatably attached to the frame and concentrically located with the pencil insertion aperture, wherein the pencil size selector dial further includes:

(a) a plurality of pencil size indicators located on the exterior of the pencil size selector dial, (i) wherein each indicator corresponds to a predetermined pencil size limit; and (b) a cam surface located on the interior of the pencil size selector dial, (i) wherein upon insertion of a pencil into the pencil insertion aperture, the cam lobes on each pencil contact lever move outward toward the cam surface, and (ii) wherein the travel distance of each pencil contact lever is restricted from the point of contact of each cam lobe to the cam surface.

8. The pencil-centering assembly of claim 7, wherein the relative location of each cam lobe is varied slightly on each pencil contact lever such that each cam lobe contacts a unique position on the cam surface at each discrete orientation of the pencil size selector dial.

9. The pencil-centering assembly of claim 7, wherein each pencil size indicator indicates a selected pencil size limit based on the position of the indicator relative to the pencil insertion aperture.

10. The pencil-centering assembly of claim 7, wherein the pencil size indicators are located around the perimeter of the exterior of rotating pencil size selector dial, and wherein a mark, notch, or ridge formed on the rotating pencil size selector dial indicates the selected pencil size limit.

11. A pencil-centering assembly for use with pencil-sharpeners, comprising:

(a) frame, wherein the frame is adapted to be detachably mounted within the housing of a pencil sharpener;

(b) a linking member rotatably mounted within the frame;

(c) a plurality of pencil contact levers, (i) wherein each contact lever in the plurality of pencil contact levers includes a top portion and a bottom portion, (ii) wherein the top portion of each pencil contact lever is adapted to engage the linking member, (iii) wherein the bottom portion of each pencil contact lever, in combination with the other pencil contact levers, defines a pencil insertion aperture having a center axis, and (iv) wherein the bottom portion of each pencil contact lever extends in to the pencil insertion aperture to about the same predetermined distance; and (d) a plurality of biasing members connected to the linking member, (i) wherein each biasing member exerts force on each pencil contact lever by way of the linking member sufficient to bias each pencil contact lever toward the center axis of the pencil insertion aperture.

12. The pencil-centering assembly of claim 11, wherein the force exerted by each biasing member on each pencil contact lever is substantially equal.

13. The pencil-centering assembly of claim 11, wherein the plurality of pencil contact levers includes three contact levers equally spaced at 120 degree angles and directed toward the center axis of the pencil insertion aperture.

14. The pencil-centering assembly of claim 11, wherein each pencil contact lever further includes a cam lobe formed in the bottom portion thereof.

15. The pencil-centering assembly of claim 11, further comprising:

(a) a switch actuation protrusion mounted on the linking member, wherein the switch actuation protrusion further includes an inclined surface;

(b) a switch actuation pin adapted to cooperate with the inclined surface; and (c) an electrical micro-switch adapted for use with an electric pencil sharpener, wherein the electrical micro-switch actuates an electric motor included in the electric pencil sharpener when the inclined surface contacts the switch actuation pin.

16. The pencil-centering assembly of claim 11, further comprising:

(a) a switch actuation protrusion mounted on the linking member, wherein the switch actuation protrusion further includes a contoured surface;

(b) a switch actuation pin attached to an electrical micro-switch adapted for use with a pencil sharpener that includes an electric motor; and (c) a pushrod disposed between the switch actuation protrusion mounted on the linking member and the switch actuation pin, (i) wherein pushrod includes a contoured surface on one end thereof that is adapted to cooperate with the contoured surface on the switch actuation protrusion mounted on the linking member and move the pushrod forward into contact with the switch actuation pin when the linking member rotates, and (ii) wherein the electrical micro-switch actuates the electric motor of the pencil sharpener when the pushrod contacts the switch actuation pin.

17. The pencil-centering assembly of claim 14, further comprising a pencil size selector dial rotatably attached to the frame and concentrically located with the pencil insertion aperture, wherein the pencil size selector dial further includes:

(a) a plurality of pencil size indicators located on the exterior of the pencil size selector dial, (i) wherein each indicator corresponds to a predetermined pencil size limit; and (b) a cam surface located on the interior of the pencil size selector dial, (i) wherein upon insertion of a pencil into the pencil insertion aperture, the cam lobes on each pencil contact lever move outward toward the cam surface, and (ii) wherein the travel distance of each pencil contact lever is restricted from the point of contact of each cam lobe to the cam surface.

18. The pencil-centering assembly of claim 14, wherein the relative location of each cam lobe is varied slightly on each pencil contact lever such that each cam lobe contacts a unique position on the cam surface at each discrete orientation of the pencil size selector dial.

19. The pencil-centering assembly of claim 14, wherein each pencil size indicator indicates a selected pencil size limit based on the position of the indicator relative to the pencil insertion aperture.

20. The pencil-centering assembly of claim 14, wherein the pencil size indicators are located around the perimeter of the exterior of rotating pencil size selector dial, and wherein a mark, notch, or ridge formed on the rotating pencil size selector dial indicates the selected pencil size limit.

21. A pencil-centering assembly for use with pencil-sharpeners, comprising:

(a) frame, wherein the frame is adapted to be detachably mounted within the housing of a pencil sharpener;

(b) a linking member rotatably mounted within the frame, the linking member having a plurality of notches in an inner surface of the linking member;

(c) a plurality of pencil contact levers, (i) wherein each contact lever in the plurality of pencil contact levers includes a top portion and a bottom portion, (ii) wherein the top portion of each pencil contact lever comprises a protrusion adapted to engage one of the plurality of notches, (iii) wherein the bottom portion of each pencil contact lever, in combination with the other pencil contact levers, defines a pencil insertion aperture having a center axis, (iv) wherein the bottom portion of each pencil contact lever extends in to the pencil insertion aperture to about the same predetermined distance, and (v) wherein each pencil contact lever includes a cam lobe formed in the bottom portion thereof;

(d) a plurality of biasing members connected to the linking member, (i) wherein at least one of the plurality of biasing members exerts a force on each pencil contact lever by way of the linking member sufficient to bias each pencil contact lever toward the center axis of the pencil insertion aperture;

(e) a pencil size selector dial rotatably attached to the frame and concentrically located with the pencil insertion aperture, wherein the pencil size selector dial further includes:

(i) a plurality of pencil size indicators located on the exterior of the pencil size selector dial, wherein each indicator corresponds to a predetermined pencil size limit;

(ii) a cam surface located on the interior of the pencil size selector dial, a) wherein upon insertion of a pencil into the pencil insertion aperture, the cam lobes on each pencil contact lever move outward toward the cam surface, b) wherein the travel distance of each pencil contact lever is restricted from the point of contact of each cam lobe to the cam surface; and (f) wherein the relative location of each cam lobe is varied slightly on each pencil contact lever such that each cam lobe contacts a unique position on the cam surface at each discrete orientation of the pencil size selector dial, (g) wherein the assembly is configured such that, upon insertion of a pencil into the pencil insertion aperture, the pencil engages the bottom portion of one or more of the plurality of pencil contact levers such that the one or more of the plurality of pencil contact levers exerts a force on at least one of the plurality of biasing members that rotates the linking member via the protrusion of the top portion engaging the notch of the linking member.

22. The pencil-centering assembly of claim 21, wherein the force exerted by at least one of the plurality of biasing members on each pencil contact lever is substantially equal.

23. The pencil-centering assembly of claim 21, wherein the plurality of pencil contact levers includes three contact levers equally spaced at 120 degree angles and directed toward the center axis of the pencil insertion aperture.

24. The pencil-centering assembly of claim 21, further comprising:

(a) a switch actuation protrusion mounted on the linking member, wherein the switch actuation protrusion further includes an inclined surface;

(b) a switch actuation pin adapted to cooperate with the inclined surface; and (c) an electrical micro-switch adapted for use with an electric pencil sharpener, wherein the electrical micro-switch actuates an electric motor included in the electric pencil sharpener when the inclined surface contacts the switch actuation pin.

25. The pencil-centering assembly of claim 21, further comprising:

(a) a switch actuation protrusion mounted on the linking member, wherein the switch actuation protrusion further includes a contoured surface;

(b) a switch actuation pin attached to an electrical micro-switch adapted for use with a pencil sharpener that includes an electric motor; and (c) a pushrod disposed between the switch actuation protrusion mounted on the linking member and the switch actuation pin, (i) wherein pushrod includes a contoured surface on one end thereof that is adapted to cooperate with the a contoured on the switch actuation protrusion mounted on the linking member and move the pushrod forward into contact with the switch actuation pin when the linking member rotates, and (ii) wherein the electrical micro-switch actuates the electric motor of the pencil sharpener when the pushrod contacts the switch actuation pin.

26. The pencil-centering assembly of claim 21, wherein each pencil size indicator indicates a selected pencil size limit based on the position of the indicator relative to the pencil insertion aperture.

27. The pencil-centering assembly of claim 21, wherein the pencil size indicators are located around the perimeter of the exterior of rotating pencil size selector dial, and wherein a mark, notch, or ridge formed on the rotating pencil size selector dial indicates the selected pencil size limit.

* * * * *